United States Patent [19]

Flegal

[11] Patent Number: 4,733,228

[45] Date of Patent: Mar. 22, 1988

[54] TRANSFORMER-COUPLED DRIVE NETWORK FOR A TFEL PANEL

[75] Inventor: Robert T. Flegal, Beaverton, Oreg.

[73] Assignee: Planar Systems, Inc., Beaverton, Oreg.

[21] Appl. No.: 760,990

[22] Filed: Jul. 31, 1985

[51] Int. Cl.[4] ..... G09G 3/28

[52] U.S. Cl. ..... 340/719; 340/778; 340/781; 340/805

[58] Field of Search ..... 340/777, 781, 784, 811-814, 340/718, 719, 778, 805

[56] References Cited

U.S. PATENT DOCUMENTS

| | | | |
|---|---|---|---|
| 3,749,977 | 7/1973 | Sliker | 340/781 |
| 3,991,416 | 11/1976 | Byles et al. | 340/784 |
| 4,070,663 | 1/1978 | Kanatani et al. | 340/781 |
| 4,349,816 | 9/1982 | Miller et al. | 340/781 |
| 4,492,957 | 1/1985 | Marentic | 340/777 |
| 4,594,589 | 6/1986 | Ohba et al. | 340/781 |
| 4,633,141 | 12/1986 | Weber | 340/781 |

OTHER PUBLICATIONS

"A Low-Power Drive Scheme for AC TFEL Displays," Marvin L. Higgins, SID 85, Society for Information Display Digest.

Sharp Symmetric Drive.

*Primary Examiner*—Marshall M. Curtis

*Attorney, Agent, or Firm*—Chernoff, Vilhauer, McClung & Stenzel

[57] ABSTRACT

A drive network for a TFEL panel includes a series resonant drive circuit for producing pulses of a predetermined frequency, a transformer for coupling the drive circuit to a TFEL panel, and symmetrically driven push-pull row drivers, a plurality of which may be implemented on a single integrated circuit chip. The transformer includes switching means for alternately providing positive and negative high-voltage pulses for the row drivers on alternate frames of data. The network formed by the series resonant drive circuit and the TFEL panel is a series RLC circuit which is driven at its resonant frequency.

11 Claims, 10 Drawing Figures

FIG. 3
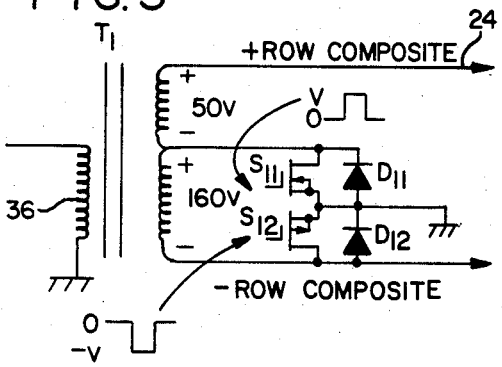
FIG. 3a
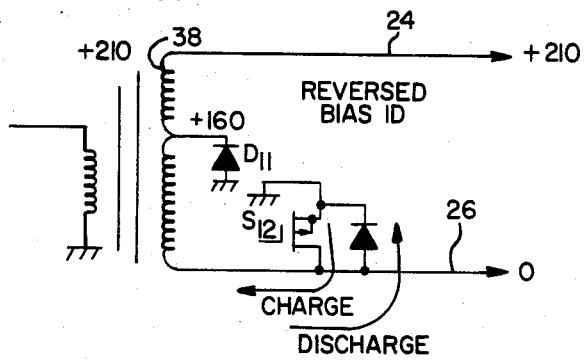
FIG. 3b
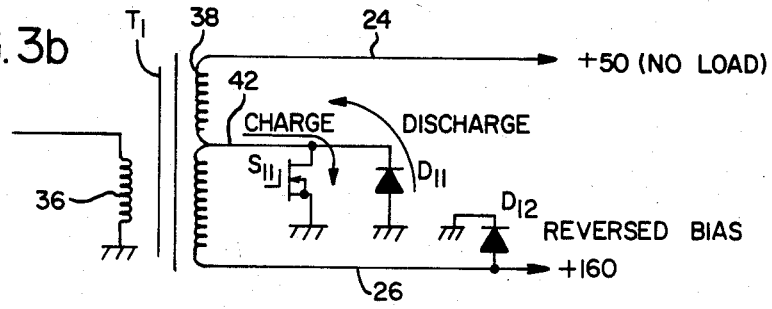
FIG. 4
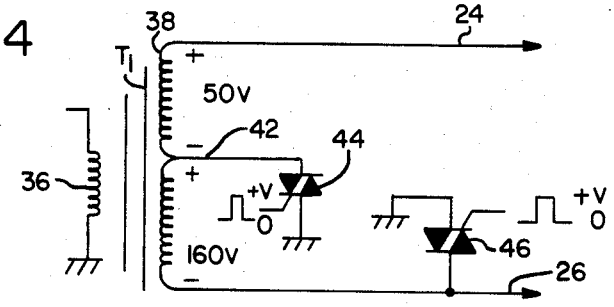
FIG. 5
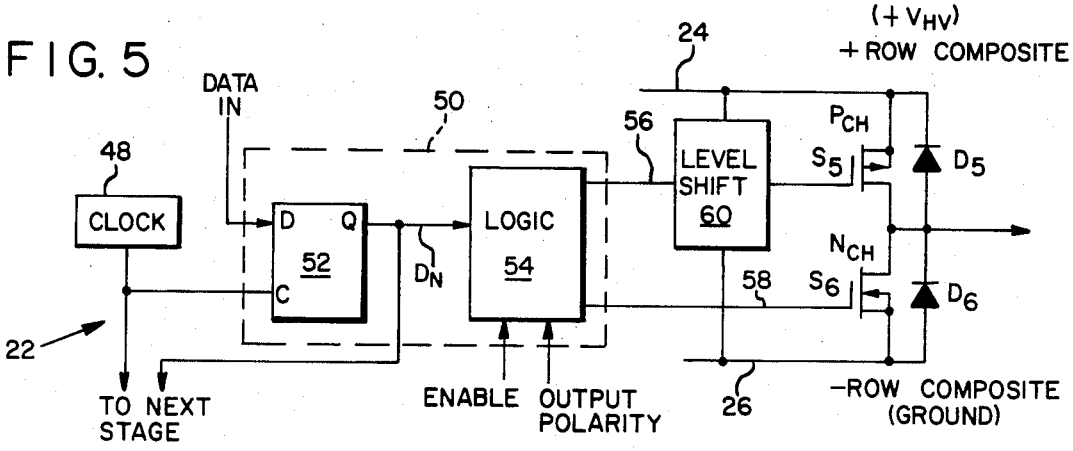
FIG. 5a
| DATA IN | ENABLE | OUTPUT POLARITY | Q OUTPUT | |
|---|---|---|---|---|
| | | | $N_{CH}$ | $P_{CH}$ |
| 0 | 1 | X | OFF | OFF |
| 1 | 1 | 0 | ON | OFF |
| 1 | 1 | 1 | OFF | ON |

TRANSFORMER-COUPLED DRIVE NETWORK FOR A TFEL PANEL

BACKGROUND OF THE INVENTION

The following invention relates to a driving network for a low-power TFEL panel using a symmetrical addressing technique.

Thin-film electroluminescent (TFEL) panels comprise a thin electroluminescent film sandwiched between orthogonally disposed row and column electrodes to form a matrix of pixels which may be selectively illuminated. Such panels are described generally in co-pending patent applications Serial Nos. 729,974 and 728,861 and assigned to the same assignee. An important consideration in the design of such panels is conservation of energy so that the panel may be made more compact with fewer and lighter components. Also, reduction of power consumption is a key factor in obtaining a better optical image, longer screen life, and portability.

One problem with conventional TFEL panels is their tendency to produce a latent image. This effect is due to the inability of the driving network to completely remove the luminescence of pixels illuminated in a previous frame of data. Usually a frame of data consists of the line-by-line illumination of pixels along a plurality of row electrodes which are sequentially charged beginning with the row at the top of the screen and proceeding to the bottom. As the pixels in one frame are illuminated, the luminescence of the pixels on the previous frame must be eliminated. This requires the use of what has been termed a "refresh" pulse which is a high-voltage pulse of polarity opposite that of the polarity of the illuminated pixels. The refresh pulse is thus used to "erase" an illuminated pixel which has been "written" with a high preconditioning row electrode voltage called a "write" voltage in combination with a column "modulation" voltage impressed upon those columns for which pixels in a particular row are to be illuminated. Contrast and latent image may be problems where the refresh pulse does not effectively eliminate the previous pixel charge. The resulting residual luminescence may create a latent image or a screen having lower contrast between lit and unlit pixels.

In addition, conventional driving architecture provides no means of recovering any of the energy from the panel and therefore there exist $I^2R$ losses which are dissipated as heat. Heat, however, tends to decrease the display lifetime of the panel.

Several of the above-mentioned problems, in particular the problems with latent images, low contrast and lifetime of the panel have been partially rectified by the use of symmetric drive. Symmetric drive has been incorporated in a TFEL panel manufactured by Sharp Electronics, Model No. LJ512u05. The Sharp symmetric drive scheme utilizes pulses of alternating polarity on even and odd rows, respectively. For example, for a particular frame when even rows have a positive polarity, odd rows will have a negative polarity. This type of symmetric drive implementation leads, however, to a problem peculiar to TFEL panels. TFEL panels are, in part, piezoelectric. Shifting the polarity of adjacent pixels during the writing of a frame of data may at certain frequencies cause the panel itself to emit sound or "squeal." It is obviously undesirable for the panel to vibrate with an audible frequency.

A second problem with the aforementioned Sharp symmetric drive technique is the need for complimentary pairs of integrated circuit chips for the row drivers. Since the row drivers alternate between negative and positive polarity, both N-type and P-type FET's must be used. This doubles the number of components needed to drive the rows over conventional non-symmetric addressing techniques.

Previous drive schemes also provided no means for recovering power from the TFEL panel. As mentioned above, all power heretofore has been dissipated in the form of heat and/or light. A desirable feature in such panels would be the conversion of what are normally $I^2R$ losses into useful power that could be recovered from the panel. It is known that there exist power recovery techniques for use with AC TFEL displays. For example, in "A Low Power Drive Scheme for AC TFEL Displays," *Society For Information Display Digest,* 1985, by Marvin L. Higgins, a series resonant circuit for driving the column electrodes of a TFEL display is described. Since the display panel is largely capacitive, the column drive network provides an inductive reactance such that the circuit formed by the column driver and the TFEL panel becomes a series-connected RLC circuit. Drive pulses are provided at the resonant frequency of the circuit but are clamped at predetermined voltage levels to prevent the circuit from oscillating. In this way power provided to the largely capacitive panel may be recovered and stored as energy in the primarily inductive series resonant circuit. This approach, however, has not been used on symmetric drive TFEL panels.

A further consideration is the efficiency of the circuit components needed to drive such panels. A high-voltage switching power supply is usually needed to provide the column and row drivers with high-voltage pulses, and typically such pulses may be on the order of +210 to −160 volts for the row drivers and +50 volts for the column drivers. These switching power supplies, however, are only approximately 75% efficient and require components that increase the physical size of the circuit boards necessary to drive the panel.

What is needed, therefore, is a low-power TFEL display panel using symmetric drive addressing while taking advantage of series resonant power recovery techniques and at the same time reducing circuit board size and complexity.

SUMMARY OF THE INVENTION

The present invention provides the above capability together with other features and improvements to provide an energy-efficient, low-power TFEL symmetric drive network. The invention utilizes transformer coupling between a series resonant drive network which provides pulses of a predetermined frequency to the drive elements for the row and column electrodes of the TFEL panel. The transformer also includes electronic switching for providing a symmetric drive addressing technique. A plurality of push-pull row drivers may be combined on a single-chip integrated circuit logically controlled to provide both positive and negative drive pulses on alternate frames of data.

A series resonant drive circuit provides pulses having a predetermined frequency and having an amplitude clamped at a predetermined voltage level. The clamp prevents the resulting resonant circuit from oscillating and the frequency of the output waveform is the resonant frequency of a series RLC circuit formed by the TFEL panel and the series resonant circuit. The TFEL panel is largely capacitive, that is, the intersections of row and column electrodes form capacitive pixels which may be modeled as a single capacitor. The value of the capacitor varies, but it has a determinable average value based upon the supposition that 45% of the screen pixels are usually illuminated.

The series resonant circuit is largely inductive. An inductor, which is connected in series with the output of this circuit, has a value such that at the resonant frequency, the inductive reactance of the circuit equals the average capacitive reactance of the TFEL panel. In this way energy is alternately stored in the inductor and provided to the panel.

A transformer is connected to the output of the series resonant circuit for providing pulses having the requisite voltages to the row and column drivers. According to the symmetric addressing technique used in the invention, the transformer alternately provides voltages of +210 volts and −160 volts to the row driver IC's. The transformer also provides a 50-volt modulation voltage to the column drivers. A switching network connected to the secondary of the transformer dictates whether the row driver IC's are provided with +210 volts or −160 volts. Thus, on a first image frame all rows are written with +210 volts and on the next image frame all rows are written with −160 volts. The modulation voltage is positive so that in order to illuminate a pixel the voltage is withheld from the selected columns when the +210-volt write voltage is present, and is applied to selected columns when the −160-volt write voltage is present. In this way the potential difference across each of the lit pixels is 210 volts. Dark pixels have a potential voltage across the panel of 160 volts, which is below the threshold of luminescence.

A symmetric drive for the TFEL panel is provided by a row driver circuit which may be incorporated in a single-chip integrated circuit. One intergrated circuit chip may provide write voltage pulses for as many as 34 rows. The chip includes positive and negative high-voltage switches which provide either the positive row composite voltage or the negative row composite voltage to one of the 34 outputs. The outputs are sequentially activated in turn by control logic pulses from a shift register. During alternate image frames the shift register actuates either the positive or the negative high-voltage switches. After each of the row electrodes have been provided with a write voltage of a first image polarity during a first frame, the shift register repeats its cycle, activating the other high-voltage switches so that all of the rows are sequentially provided with a write voltage of the opposite polarity.

As the row electrodes are being sequentially activated with a write voltage, the column electrodes are selectively charged to illuminate selected pixels in a particular row. The column electrodes are selectively provided with either +50 volts for a high signal of 0 volts for a low signal. The threshold of luminescence for the pixels is approximately 180 volts. Thus, when the row electrodes are being written with −160 volts, selected pixels are illuminated by providing the corresponding column electrodes with a +50-volt pulse. This makes the potential difference across the panel 210 volts at certain pixels, which is above the threshold of luminescence and illuminates those selected pixels. On the other hand, when a +210-volt write voltage is provided to the row electrodes, the selected column electrodes are provided with 0 volts which makes the selected pixels have a potential difference across the panel of 210 volts, and non-selected column electrodes are provided with a +50-volt pulse which brings the potential difference across the panel at these pixels down to 160 volts which is below the threshold of luminescence. In this way only three voltage levels are needed to illuminate selected pixels and, yet, at the same time provide an energy-efficient, symmetrically driven panel.

It is a primary object of this invention to provide a compact, energy-efficient TFEL panel having low power consumption.

Yet a further object of this invention is to provide transformer coupling between a driving network and a TFEL panel, thus obviating the need for a switching power supply.

Yet a further object of this invention is to reduce the power consumption of a TFEL panel by driving the panel with a series resonant network, coupled with a symmetric drive addressing technique.

A still further object of this invention is to simplify the row driving circuits for a TFEL panel by providing a single integrated circuit chip row driver capable of supplying both positive and negative driving pulses for the panel on alternate data frames.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 2(*a*) is a waveform diagram illustrating the operation of the TFEL panel shown in FIG. 1 as driven by the driving network illustrated in FIG. 2.

FIG. 3 is a schematic diagram of a portion of the transformer coupling for the TFEL panel illustrated in FIG. 2.

FIG. 3(*a*) is a schematic representation of the circuit configuration of FIG. 3 when switch S12 is activated.

FIG. 3(*b*) is a schematic representation of the circuit configuration of FIG. 3 when switch S11 is activated.

FIG. 4 is a schematic diagram of a portion of the transformer shown in FIG. 2 utilizing thyristors as switching elements.

FIG. 5(*a*) is a table illustrating the operation of the circuit of FIG. 5.

FIG. 5(*b*) is a waveform diagram illustrating the method of operation of the row driver circuit illustrated in FIG. 5.

DETAILED DESCRIPTION OF THE INVENTION

Figure 1:
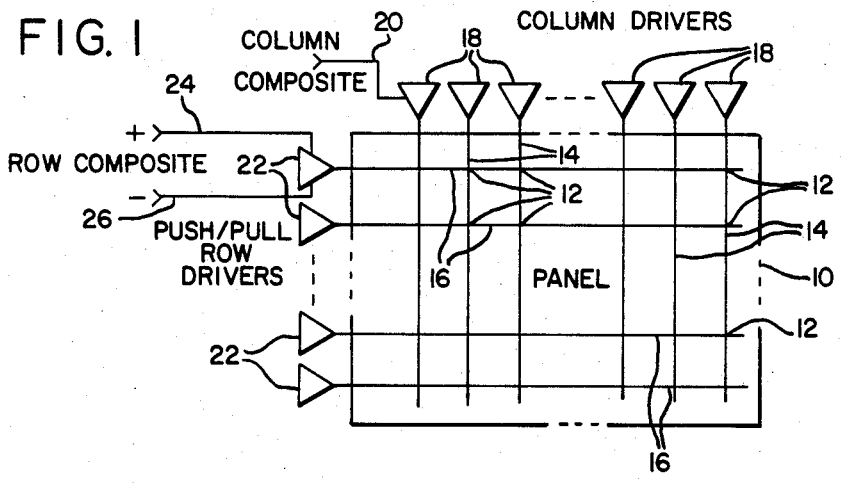
FIG. 1 is a schematic diagram of a TFEL panel comprising a matrix of pixels formed by the intersections of row and column electrodes.

A TFEL panel 10 includes a plurality of pixels 12 which are formed by the intersections of a plurality of column electrodes 14 and row electrodes 16. A typical TFEL panel 10 may include 256 row electrodes 16 and 512 column electrodes 14. Each of the column electrodes 14 are driven by a column driver amplifier 18. The high voltage necessary to drive the column electrodes 14 is provided to each of the column drivers 18 via the column composite voltage line 20. The rows 16 are driven by push-pull row drivers 22. A plurality of row drivers 22 may be incorporated in a single integrated circuit chip as will be explained hereinbelow. The row drivers 22 are driven by row composite voltage lines 24 (positive) and 26 (negative).

Figure 2:
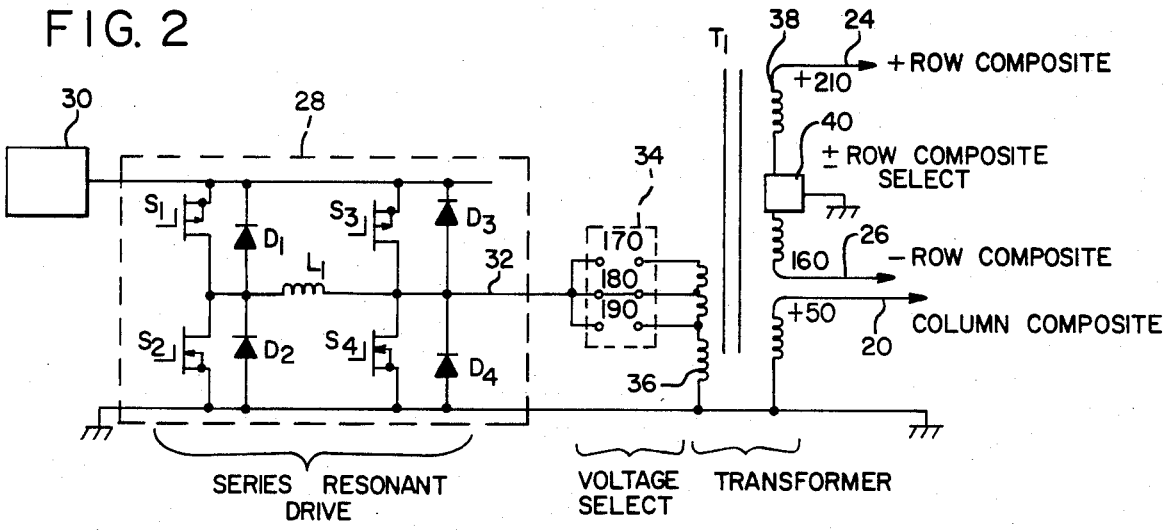
FIG. 2 is a schematic diagram of a driving network for the TFEL panel of FIG. 1.
Figure 2A:
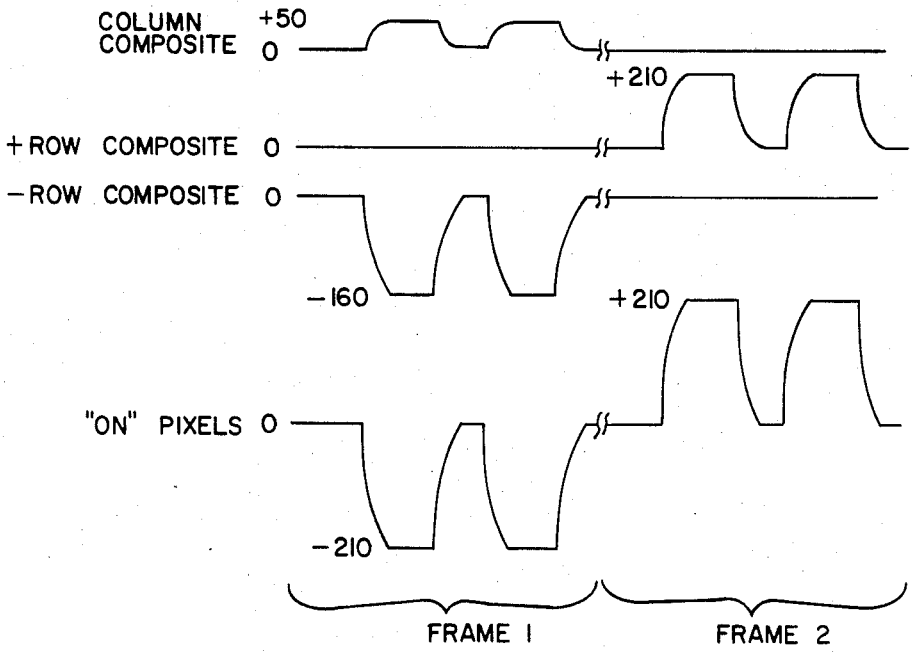

The driving network that provides the voltages for row composite voltage lines 24 and 26 and column composite voltage line 20 is shown in FIG. 2. A series resonant drive circuit 28 is connected to a high power regulated voltage supply 30. The series resonant drive circuit consists of 4 switches, S1, S2, S3 and S4 and associated diodes, D1, D2, D3 and D4 which are connected between the source and drain of each of the respective switches S1, S2, S3 and S4. An inductor L1 is connected in series with an output line 32. The output line 32 is connected to a selector switch 34 which may be used to adjust the output of the drive circuit 28 to compensate for small differences which may arise in the construction of individual panels. The output of switch 34 is connected to the primary coil 36 of a transformer T1. T1 is a step-up transformer which converts the 11-volt output of the series resonant drive circuit 28 to the high-voltage pulses needed to drive the TFEL panel 10. These high-voltage pulses appear on lines 20, 24 and 26, respectively, which are connected to the secondary 38 of transformer T1. An electronic switch 40 whose operation is to be explained below alternately provides either positive row composite voltage line 24 or negative row composite voltage line 26 on alternate image frames with the proper voltage level.

An image frame is written on the screen by sequentially energizing each of the row electrodes 16 and simultaneously energizing selected ones of the column electrodes 14. At the intersection of a sequentially energized row electrode 16 and a selectively energized column electrode 14 a pixel 12 will be illuminated. On a conventional TFEL panel the frame rate is 60 image frames per second, and in general, the row electrodes are energized in turn starting at the top of the panel 10.

The pixels 12 are largely capacitive because they consist of two electrodes separated by a dialectric medium. Thus, the entire panel provides an essentially capacitive load for the incoming drive pulses. It is this electrical property of the panel 10 that makes the series resonant drive circuit 28 an especially efficient means of driving the panel 10. The theory of operation of such circuits is explained in the paper entitled "A Low Power Drive Scheme For AC TFEL Displays" identified above. Briefly, however, the switches S1, S2, S3 and S4 and their associated diodes D1, D2, D3 and D4 provide pulses of a predetermined frequency, at which the reactance of the inductor L1 substantially matches the average capacitive reactance of the TFEL panel 10 so that the combined network formed by the combination of the series resonant drive circuit 28 and TFEL panel 10 is an RLC series-connected resonant circuit. This assumes an average capacitance for the TFEL panel that is based upon a 45% "fill" factor, i.e., approximately 45% of the pixels 12 are illuminated at any given time.

The switches S1, S2, S3 and S4 which provide drive pulses of the proper frequency are controlled by a logic circuit (not shown) which opens and closes selected ones of the switches S1, S2, S3 and S4 at predetermined times. An example of the switching operation of such a circuit can be found in the paper referred to above. Other switching schemes could be used, however, since it is important only that the drive pulses have the proper frequency so that the respective capacitive and inductive reactances are approximately equal. The transformer T1 is a tightly coupled low-loss transformer which is largely transparent to the drive pulse output of the series resonant drive circuit 28 and provides no inductive loading for output line 32. Since the panel 10 operates essentially on AC current, energy is alternately provided to the capacitive panel 10, and stored in inductor L1. Diodes D1–D4 are used to steer the inductor current to the supply 30 during energy recovery and to limit the inductor voltage.

The switch 40 provides high-voltage driving pulses of alternate polarity to the row drivers 22 as illustrated by the waveform diagram in FIG. 2(*a*). Two arbitrary image frames labeled Frame 1 and Frame 2 illustrate how pixels are energized with the symmetric drive technique of the invention. In Frame 1 the switch 40 provides pulses of −160 volts on the negative row composite output line 26. At the same time +50-volt pulses are provided on column composite voltage line 20 to the column drivers 18. Whether the 50-volt pulse is supplied to a particular column electrode 14 is determined by a data input (not shown) to the column drivers 18. In the illustration of FIG. 2(*a*), however, two such pixels have been provided with an enabling data signal that permits the column drivers 18 to provide the +50-volt pulse to selected ones of the column electrodes 14. The result is that on selected pixels there is a −210-volt potential across the panel 10 and the pixels are illuminated. On the alternate frame, Frame 2, the positive row composite line 24 is selected by the switch 40 which provides a +210-volt pulse to each of the row drivers 22. However, in this case, the selected column drivers 18 are inhibited so that the +50-volt pulse on line 20 is not applied to the pixels which are to be lit. The result is once again a 210-volt potential difference across the panel 10 at those pixels 12 resulting in luminescence. In Frame 1, dark pixels would have 0 volts on the column electrode and in Frame 2, they would have a 50-volt pulse on their respective column electrodes. The resulting voltage across the panel at these points would be only 160 volts which is below the threshold of luminescence.

A means of providing the row drivers 22 with alternating pulses of +210 volts and −160 volts, respectively, as shown in FIG. 3. In this illustration a network consisting of switch S11, S12 and diodes D11 and D12 is connected to a center tap 42 on the secondary coil 38 of transformer T1. Switches S11 and S12 are alternately turned on and off by negative and positive control voltage pulses which are alternately applied to their gates. FIG. 3(*a*) illustrates the configuration of the circuit when switch S12 is turned on. In this case 210 volts is applied to positive row composite line 24 since the current at center tap 42 is blocked by diode D11. Since S12 is on, however, the current entering the coil 38 charges through open switch S12 and discharges to ground through diode D12.

As shown in FIG. 3(*b*) on alternate frames, switch S12 remains open and switch S11 is closed. This allows current to charge through switch S11 and discharge through diode D11 at center tap 42. Current flow from ground potential is blocked, on the other hand, by diode D12. This results in a −160-volt pulse on negative row composite line 26. This also results in a positive 50-volt pulse being placed on positive row composite line 24 which is decoupled from the push-pull row drivers 22 so that no load is presented to that line.

An alternate switching configuration is shown in FIG. 4. In this configuration thyristors 44 and 46 are used to control the switching of the output of transformer T1. The thyristors are simpler to implement because both may be controlled by positive pulses, can be made physically more compact, and also have very low impedance when turned on. Line 26 and center tap 42 are alternately grounded so that when center tap 42 is grounded line 26 is 160 volts below ground, and when line 26 is grounded, line 24 is 210 volts above ground.

Figure 5B:
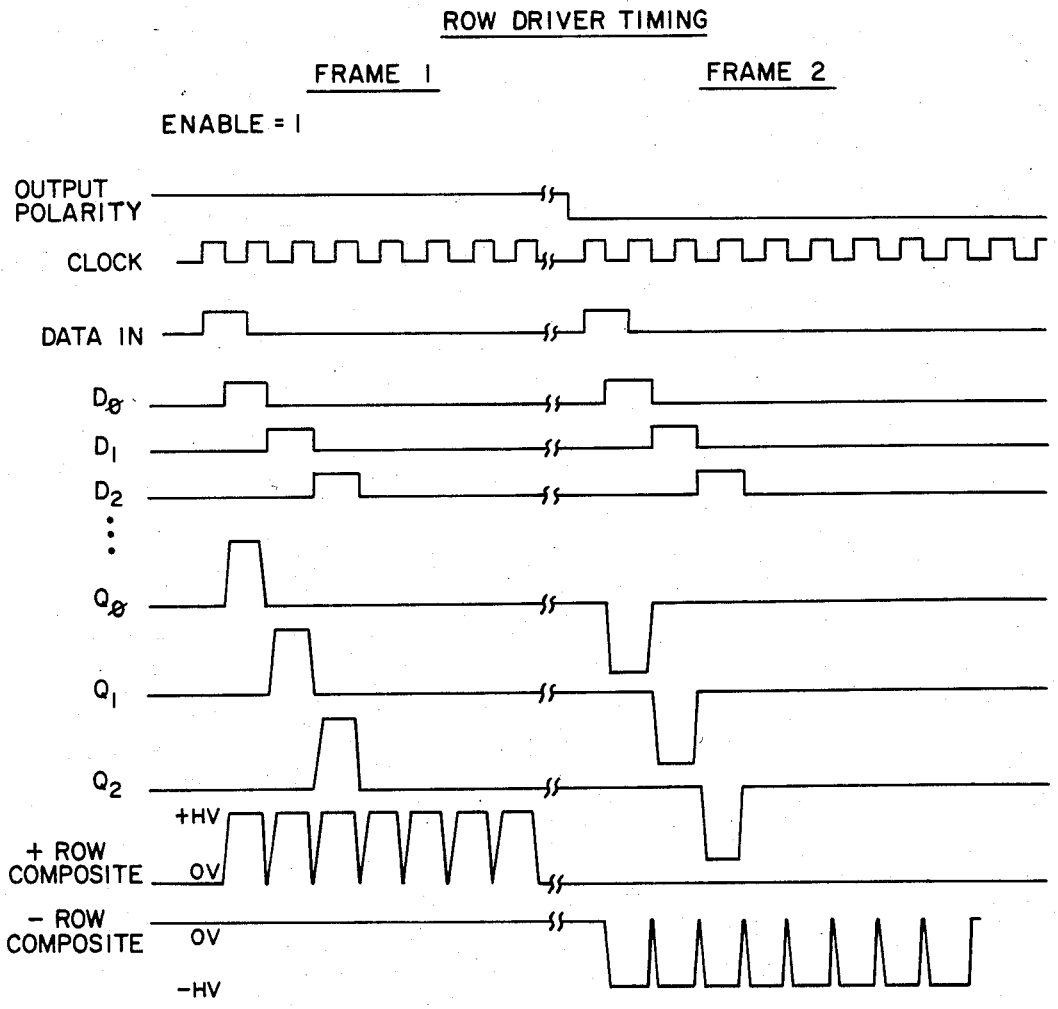
FIG. 5 is a schematic diagram of a row electrode driving circuit embodied in an integrated circuit chip.

The positive and negative row composite lines 24 and 26, respectively, are supplied to push-pull row drivers 22, one of which is shown in FIG. 5. A number of the drivers 22 may be implemented on a single-chip integrated circuit. For example, the row driver of FIG. 5 is illustrative of 1 of 34 such row drivers 22 which may be included on a single integrated circuit chip. Each symmetric row driver 22 consists of a clock 48 which drives a shift register 50. The shift register includes a data input element 52 and a logic element 54. Two complimentary output lines of the shift register, lines 56 and 58, respectively, are used to control the switching of P-channel switch S5 and N-channel switch S6, respectively. A level shifter 60 is provided for the P-channel switch S5, because P-channel switch S5 is referenced to the +210-volt row composite line 24. The N-channel switch S6 is referenced to ground and thus may be driven directly by the logic signal output from the shift register 50.

In FIG. 5(*a*) a truth table shows the output of the row driver 22 on line Q. Since the logic unit 54 is permanently enabled, the output on line Q depends upon the presence of a data input and the condition of the output polarity line 62. The symmetric row driver 22 illustrated in FIG. 5 is the first row at the top of the screen 10 and as such includes a data input line 64 to the shift register 50. For subsequent rows, that is, rows 2 through 256, a line such as internal line D from shift register 50 provides the data input for the next row. As shown in FIG. 5(*a*), the data line input from line 64 is clocked through the shift register on line D and is represented by pulses $D_0$, D1, D2, . . . Dn. When a data pulse from line D is present at the input of logic unit 54, either the N-channel switch S6 or the P-channel switch S5 will be turned on. When this happens row composite line 24 or the negative row composite line 26 is gated to output line Q. Output line Q is in turn one of a plurality of output lines from the single-chip integrated circuit and represents one of the row electrodes 16. Therefore, at the beginning of each frame the data impulse on line 64 is sequentially clocked through the shift register 50 and, depending on the output of polarity line 62, sequentially energizes in turn each of the row electrodes 16 from the top of the screen to the bottom. On the next frame the output polarity shifts and line Q goes negative to provide 256 negative 160-volt pulses.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A driving network for a TFEL panel, said panel comprising a plurality of capacitive pixels defined by the respective intersections of a first plurality of scanning electrodes and a second plurality of data electrodes comprising a transformer having an input winding connected to a source of driving voltage and a plurality of output windings and responsive to an input pulse of a predetermined frequency for providing composite simultaneous scanning electrode and data electrode drive pulses on differing ones of said output windings and further including switching means connected to an output of said transformer for providing scanning electrode composite drive pulses of a first polarity during a first image frame and scanning electrode composite drive pulses of a second polarity during a second image frame.

2. The driving network of claim 1 wherein said switching means comprises a pair of electronic switches connected to taps on a secondary coil of said transformer, said electronic switches being alternately activated by positive control signals.

3. The driving network of claim 1 wherein said switching means provides said row composite drive pulses of a first polarity sufficient to illuminate selected pixels during a first frame of data when said column electrodes are simultaneously held at ground potential, and said switching means provides said pulses of a second polarity sufficient to illuminate selected pixels during a second frame of data when selected column electrodes are simultaneously provided with said column electrode drive pulses.

4. The driving network of claim 3 wherein said first polarity is positive, said second polarity is negative, and said column electrode drive pulses are positive.

5. The driving network of claim 1 further including resonant circuit means coupled between said transformer and said source of driving voltage for maximizing power recovery from said TFEL panel.

6. In an AC driven TFEL panel having orthoganally disposed scanning and data electrodes:

(a) scanning electrode driver circuit means for energizing a plurality of said scanning electrodes in line-by-line fashion
  (i) with a first voltage having a magnitude sufficient to charge said scanning electrodes to a level just below the threshold of luminescence during a first image frame; and
  (ii) with a second voltage of opposite polarity from said first voltage and having a magnitude sufficient to charge said scanning electrodes to a level just above the threshold of luminescence during a second image frame; and (b) data electrode driver circuit means for energizing selected ones of said data electrodes with a low voltage of a polarity opposite from said first voltage during said first image frame so as to cause luminescence of selected portions of said TFEL panel during said first image frame and for maintaining the voltage of selected ones of said data electrodes at substantially zero potential during said second image frame so as to cause luminescence of selected portions of said TFEL panel during said second image frame, whereby residual luminescence existing after the completion of said first image frame is diminished during said second image frame by the reversal of polarity of the voltage from said scanning electrode driver circuit means.

7. The AC driven TFEL panel of claim 6 wherein said low voltage is less than or substantially equal to +50 volts.

8. A method of illuminating selected pixels of an AC driven TFEL panel, said pixels being defined by the points of intersection of orthoganally disposed scanning and data electrodes, comprising the steps of:

(a) during a first image frame (i) energizing a plurality of said scanning electrodes with a first voltage of a first polarity having a magnitude sufficient to charge said scanning electrodes to a point just below the threshold of luminescence in line-by-line fashion;

(ii) as each scanning electrode is energized, charging selected ones of said data electrodes with a first low voltage having a polarity opposite to that of said first polarity and of a sufficient magnitude to cause luminescence of selected pixels, and (b) during a next image frame (i) energizing in line-by-line fashion said plurality of said scanning electrodes with a second voltage of a second polarity opposite that of said first polarity and having a magnitude above the threshold of luminescence of said pixels, (ii) as each scanning electrode is energized, holding selected ones of said data electrodes at a second low voltage to permit luminescence of selected pixels to be caused by said second voltage, whereby residual luminescence existing after the completion of said first image frame is diminished during said second image frame by the reversal of polarity of the voltage energizing said scanning electrodes.

9. The method of claim 8 wherein the low voltage of step (b)(ii) is substantially zero.

10. The method of claim 8 wherein the first voltage of a first polarity is approximately −160 volts and said first low voltage is approximately +50 volts.

11. The method of claim 9 wherein the second voltage is a positive voltage that barely exceeds the threshold of luminescense.

* * * * *

UNITED STATES PATENT AND TRADEMARK OFFICE

CERTIFICATE OF CORRECTION

PATENT NO. : 4,733,228

DATED : March 22, 1988

INVENTOR(S) : Robert T. Flegal

It is certified that error appears in the above-identified patent and that said Letters Patent is hereby corrected as shown below:

| | |
|---|---|
| Change the title to | --SYMMETRIC DRIVE FOR TRANSFORMER-COUPLED TFEL PANEL-- |
| Col. 2, line 56 | Change "drive" to --driver-- |
| Col. 3, line 48 | After "first" delete --image-- |
| Col. 3, line 49 | After "first" insert --image-- |
| Col. 3, line 57 | Change "of" to --or-- |
| Col. 5, line 42 | Change "dialectric" to --dielectric-- |
| Col. 6, line 48 | Change "as" to --is-- |
| Col. 6, line 49 | Change "switch" to --switches-- |
| Col. 7, line 45 | Change "$D_0$" to --$D_\phi$-- |

Signed and Sealed this

Third Day of September, 1991

*Attest:*

HARRY F. MANBECK, JR.

*Attesting Officer*

*Commissioner of Patents and Trademarks*